US008505148B2

(12) United States Patent
Atkin

(10) Patent No.: US 8,505,148 B2
(45) Date of Patent: Aug. 13, 2013

(54) PERSONAL HYGIENE BRUSH

(76) Inventor: Joshua D. Atkin, Beavercreek, OH (US)

( * ) Notice: Subject to any disclaimer, the term of this patent is extended or adjusted under 35 U.S.C. 154(b) by 726 days.

(21) Appl. No.: 12/564,545

(22) Filed: Sep. 22, 2009

(65) Prior Publication Data

US 2011/0067191 A1 Mar. 24, 2011

(51) Int. Cl.
*A46B 9/04* (2006.01)

(52) U.S. Cl.
USPC ..... 15/160; 15/106; 15/167.2

(58) Field of Classification Search
USPC ..... 15/160, 106, 167.1, 167.2, 111
See application file for complete search history.

(56) References Cited

U.S. PATENT DOCUMENTS

| | | | | |
|---|---|---|---|---|
| 1,389,624 | A | | 9/1921 | Carroll |
| 2,190,277 | A | | 2/1940 | Viragh |
| 3,559,226 | A | | 2/1971 | Burns |
| 3,588,936 | A | | 6/1971 | Duve |
| 3,934,298 | A | | 1/1976 | Kim |
| 4,128,911 | A | * | 12/1978 | Perez ..... 15/167.1 |
| 4,185,349 | A | | 1/1980 | Papas |
| 4,222,143 | A | | 9/1980 | Tarrson et al. |
| 4,319,377 | A | | 3/1982 | Tarrson et al. |
| 4,463,470 | A | | 8/1984 | Willis |
| 4,710,996 | A | | 12/1987 | Tarrson et al. |
| 5,070,567 | A | | 12/1991 | Holland |
| 5,177,827 | A | * | 1/1993 | Ellison ..... 15/22.1 |
| 5,186,627 | A | | 2/1993 | Amit et al. |
| 5,274,870 | A | | 1/1994 | Stollman |
| 5,305,491 | A | * | 4/1994 | Hegemann ..... 15/167.2 |
| 5,331,704 | A | | 7/1994 | Rosen et al. |
| 5,341,534 | A | | 8/1994 | Serbinski et al. |
| 5,378,153 | A | | 1/1995 | Giuliani et al. |
| 5,488,751 | A | | 2/1996 | Gekhter et al. |
| 5,522,109 | A | | 6/1996 | Chan |
| 5,718,667 | A | | 2/1998 | Sugimoto et al. |
| 5,732,433 | A | | 3/1998 | Gocking et al. |
| 5,758,380 | A | * | 6/1998 | Vrignaud ..... 15/106 |
| 5,896,615 | A | * | 4/1999 | Zaksenberg ..... 15/167.1 |
| 6,000,083 | A | | 12/1999 | Blaustein et al. |
| D421,841 | S | | 3/2000 | Achepohl et al. |
| 6,085,761 | A | | 7/2000 | Inaba |
| D429,567 | S | | 8/2000 | Yoshimoto et al. |
| 6,108,852 | A | * | 8/2000 | Vrignaud ..... 15/167.2 |

(Continued)

FOREIGN PATENT DOCUMENTS

| | | |
|---|---|---|
| JP | 63-3225 | 1/1988 |
| JP | 63-3226 | 1/1988 |

OTHER PUBLICATIONS

American Dental Association, *ADA Statement on Intraoral/Perioral Piercing and Tongue Splitting*, As adopted by the ADA House of Delegates, Oct. 1998 and amended Oct. 2004, http://www.ada.org/prof/resources/positions/statements/piercing.asp.

*Primary Examiner* — Shay Karls
(74) *Attorney, Agent, or Firm* — Curatolo Sidoti Co., LPA; Salvatore A. Sidoti

(57) ABSTRACT

A personal hygiene brush which includes a furcated end comprising cleaning heads from which bristles radiate about the outer perimeter and a non-furcated end including an additional cleaning head from which bristles radiate about the outer perimeter. The personal hygiene brush is capable of cleaning of all types of piercings, intra and extra-orally, as well as dental implants and implant supported prosthesis. The personal hygiene brush enables the user to clean around, under and through their individual ornamental body rings and rods without removing them from the body parts to which they are attached.

20 Claims, 8 Drawing Sheets

(56) References Cited

U.S. PATENT DOCUMENTS

| | | | | |
|---|---|---|---|---|
| 6,138,689 | A * | 10/2000 | Stern | 132/309 |
| 6,325,626 | B1 | 12/2001 | Blass | |
| D485,440 | S | 1/2004 | Snaith | |
| D487,195 | S | 3/2004 | Winkler | |
| 7,240,390 | B2 * | 7/2007 | Pfenniger et al. | 15/22.1 |
| 7,424,952 | B2 | 9/2008 | Antler | |
| 7,458,125 | B2 * | 12/2008 | Hohlbein et al. | 15/143.1 |
| D609,012 | S * | 2/2010 | Chu | D4/106 |
| D614,406 | S * | 4/2010 | Stieger | D4/105 |
| 2005/0144745 | A1 * | 7/2005 | Russell | 15/23 |

* cited by examiner

PERSONAL HYGIENE BRUSH

TECHNICAL FIELD

Disclosed is a personal hygiene cleaning brush. The brush includes a plurality of brush surfaces that facilitate a more efficient and thorough cleaning of oral and body piercings, dental implants, dental implant supported dentures, a wide variety of prosthetics and body ornaments, and surrounding tissues.

BACKGROUND

Oral and body piercings have become an increasingly popular form of self-expression in today's society. Piercings are commonly placed without sterile techniques or anesthetic, and healing takes upwards of four to six weeks. Piercings of the tongue, lip, uvula, frenum, as well as areas outside of the mouth can become easily infected and irritated not appropriately cleaned. Secondary infections are common and cases have been reported where hospitalization was necessary. For a complete discussion of intraoral/perioral piercing and tongue splitting and associated adverse oral and systemic conditions, see American Dental Association Positions and Statement, as adopted by the ADA House of Delegates October, 1998 and amended October. 2004, http://www.ada.org/prof/resources/positions/statements/piercing.asp.

Dental implants have also become increasingly popular as the aging population becomes more interested in alternatives for dentures and fixed bridge restorations. Many types of implant support prosthesis are available, including "bar retained" dentures and "ball retained" dentures, however, the ability to clean under and around the implants is difficult even if the dentures are removed. Currently, patients are instructed to brush, floss, or use interdental brushes to clean around the prosthesis.

Proper care after the placement of the piercing is a crucial component of avoiding pain, swelling and infection. Once an oral piercing is placed, cleaning instructions are limited to brushing gently with a toothbrush or rinsing with salt water. Similar instructions are given once dental implants are in place. An interdental toothbrush essentially serves two main purposes, which are removing plaque and debris from the tooth and massaging the tissue. Currently, there are no specific products on the market that are designed specifically for the cleaning of oral and body piercings or dental implants.

Most toothbrushes of the prior art include one handle and one brush. There have been variations on both the handle and their brushes. For example, curved and angled handles have been suggested. Other toothbrushes of varied shapes and designs have also been advanced. In more recent times, hygienist and dentist groups have recognized the inadequacies of prior art brushes. For instance, many brushes do not properly access all difficult to reach areas for total teeth cleaning and gum massage. Because of these needs, brushes with cone shape bristles, some with straight or angled handles, and other variations in brushes have been presented to the public. However, most users resist using more than one brush for a single cleansing.

Accordingly, it is desirable to provide an improved device to clean oral and body piercings, dental implants, dental implant supported dentures, a wide variety of prosthetics and body ornaments, and surrounding tissues, in order to maintain personal hygiene and prevent infections.

DETAILED DESCRIPTION

Figure 1:
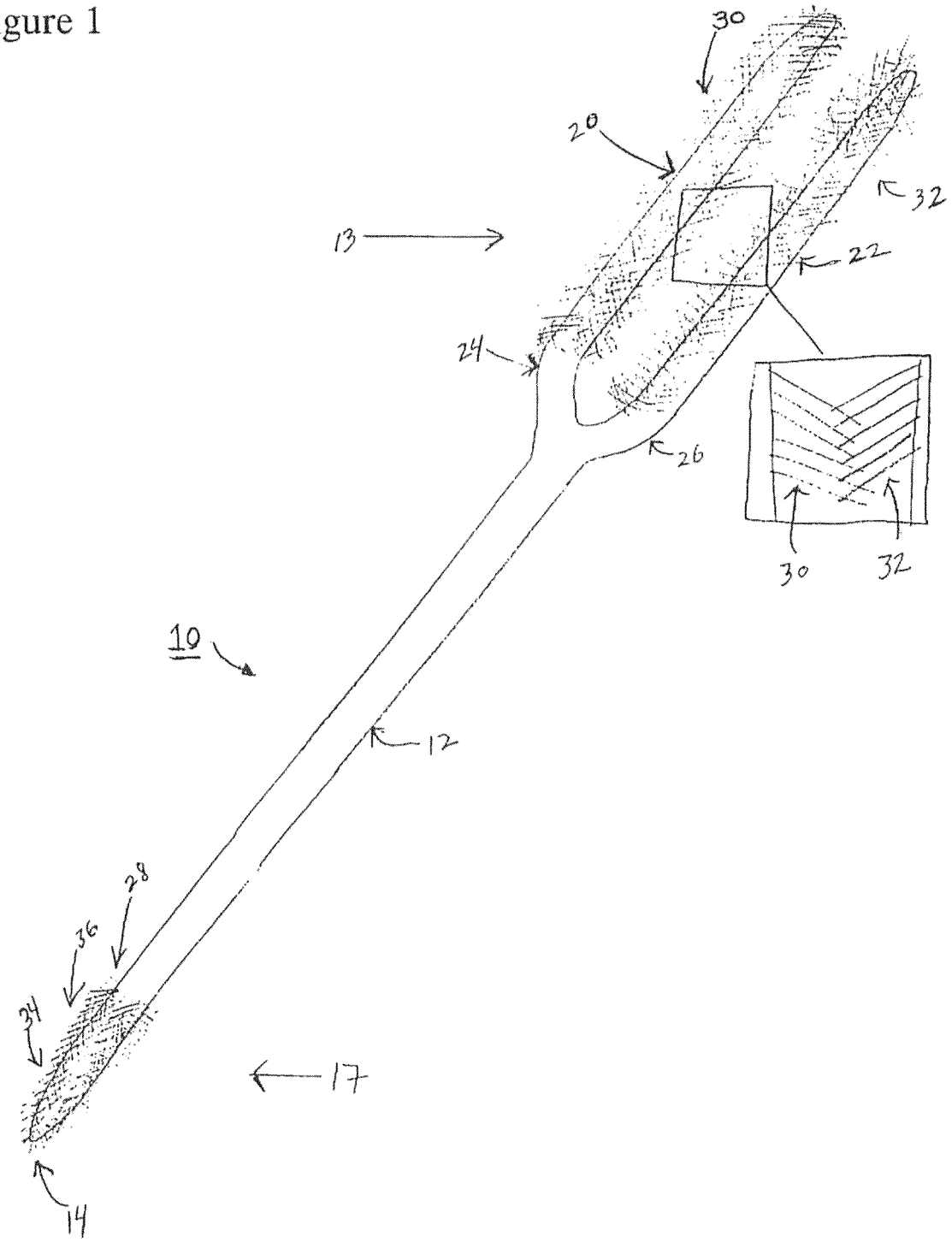
FIG. 1 is a perspective view of one illustrative embodiment of the personal hygiene device.

Disclosed is a personal hygiene device. The device includes an elongated handle having opposite ends. Brushing or cleaning heads or regions are located at one or more of the opposite ends of the elongated handle of the device. At least one end of the handle is furcated to provide more than one cleaning head or region that carries a plurality of brush bristles.

The furcated regions of the personal hygiene device are designed to overcome the limitations of a traditional toothbrush or oral hygiene brush for the cleaning of oral and body piercings, dental implants, dental implant supported dentures, and a wide variety of prosthetics and body ornaments. Each end of the device is specifically designed for clinical effectiveness, simplicity, and for a wide variety of designs of piercings, implants, prosthetics and ornaments.

The personal hygiene device allows for unobstructed movability of the brush cleaning heads down onto the epithelial or gum tissue lining oral and body piercings, dental implants, dental implant supported dentures, and a wide variety of prosthetics and body ornament, which results in reduced debris collection areas and thereby avoids bacterial growth and odor.

According to certain illustrative embodiments, one end of the handle is bifurcated and is comprised of two spaced-apart brush heads. The bifurcated brush heads may be disposed in angular, generally opposing relationship to each other. According to other embodiments, the furcated end of the handle may comprise more than two brush heads. For example, and without limitation, one end of the elongated handle may be trifurcated 64, as shown in FIG. 3A.

According to other embodiments, the brush heads of the hygiene device are flexible and the brush neck and elongated handle are rigid. According to alternative embodiments, the brush heads and brush necks of the hygiene device are flexible and the handle is rigid. According to other embodiments, the hygiene device comprises brush heads, brush necks, and handle that are flexible. According to other embodiments, the hygiene device may be provided with brush heads, brush necks, and handle that are rigid. According to other embodiments, the device may be provided with a handle that is flexible, and wherein the brush heads and brush necks are rigid. According to other embodiments, one end of the elongated handle is flexible, whereas the opposite end of the elongated handle is rigid.

According to other embodiments, the handle end comprising the furcated brush heads are flexible, whereas the opposite handle end comprising a single brush head is rigid. According to other embodiments, the handle end comprising the furcated brush heads are rigid, whereas the opposite handle end comprising a single brush head is flexible. According to other embodiments, the furcated end of the handle is comprised of flexible and rigid brush heads. According to other embodiments, the furcated end of the handle is comprised of flexible and rigid brush necks.

The hygiene device may be manufactured from a wide variety of polymer materials. The polymeric materials may comprise homopolymers, co-polymers or terpolymers. Without limitation, and by way of illustration, the device may be manufactured from nylons, polyalkylenes, such as polypropylene, rubber and ethylene-propylene-diene terpolymer (EPDM). A suitable EPDM terpolymer that may be used to manufacture is commercially available from Exxon Mobil Chemical under the tradename SANTOPRENE.

The brush heads, brush necks and elongated handle may be provided as a single integral molded piece. According to other embodiments, the brush heads, brush necks and elongated handle may be provided as separate pieces that are connected to one another by a suitable connection means.

According to other embodiments, the brush heads and brush necks are provided as a single integral piece that can be attached to the handle is provided as separate piece for replaceability purposes.

According to other embodiments, the brush necks and handle are provided as a single integral piece that can be attached to the brush heads provided as separate pieces for replaceability purposes.

According to other embodiments, the elongated handle of the device is positioned at an angle relative to the cleaning heads or regions of the device.

The cleaning regions may be shaped in a spiralling, twisting or cork-screw manner from which individual brush bristles radiate outwards.

The elongated handle of the device is comprised of a cylindrical handle. The cylindrical handle may include a circumferential thumb rest to improve gripping and manual dexterity when in use. Alternatively, the elongated handle may be provided with indentations to improve gripping and manual dexterity when in use. According to other embodiments, the device includes a cylindrical handle, the center portion of which is comprised of a softer or less rigid material than the other handle portions that extend away from the central handle portion to improve gripping and manual dexterity when in use.

Figure 3:
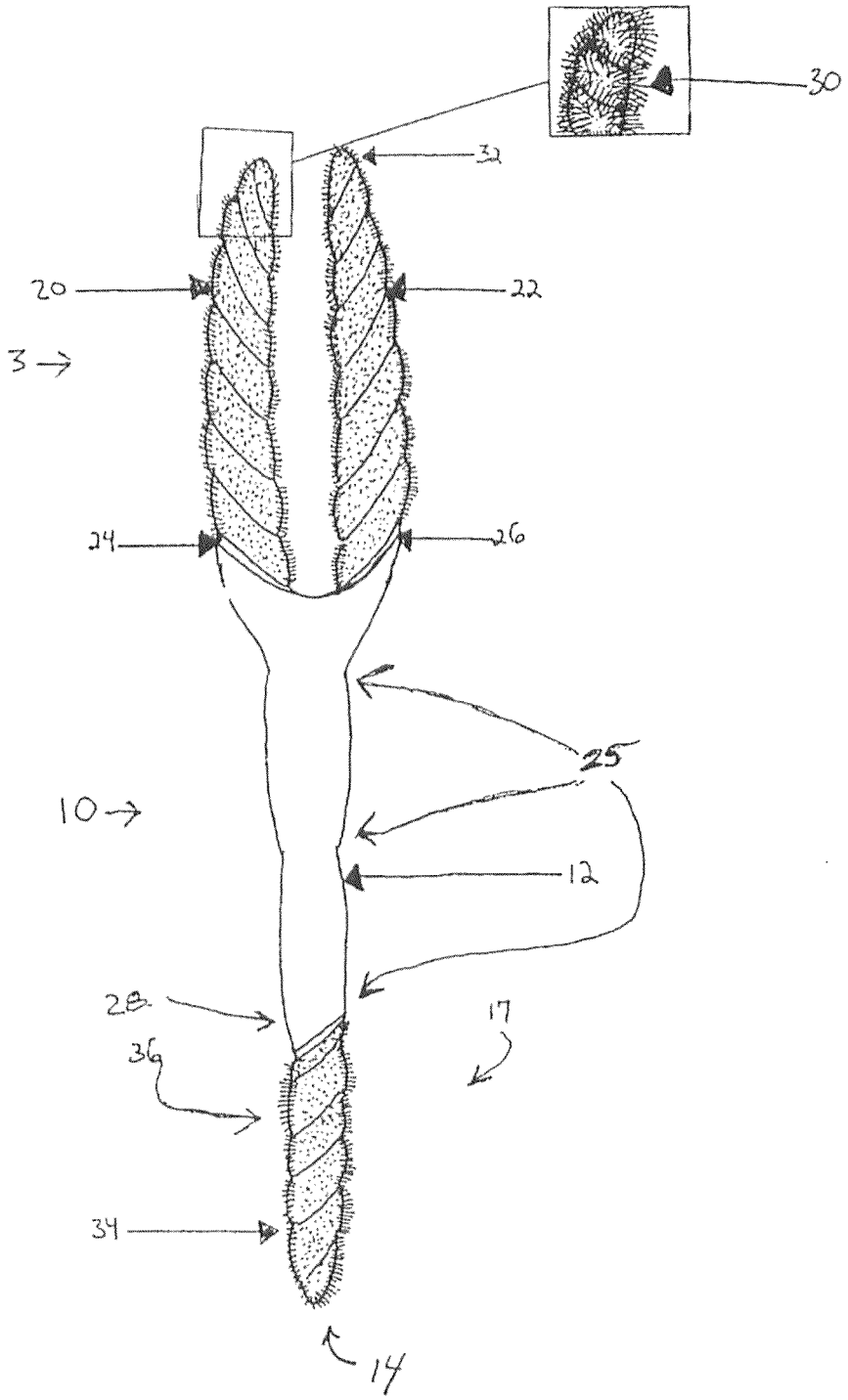
FIG. 3 is a perspective view of another illustrative embodiment of the personal hygiene device.
Figure 3A:
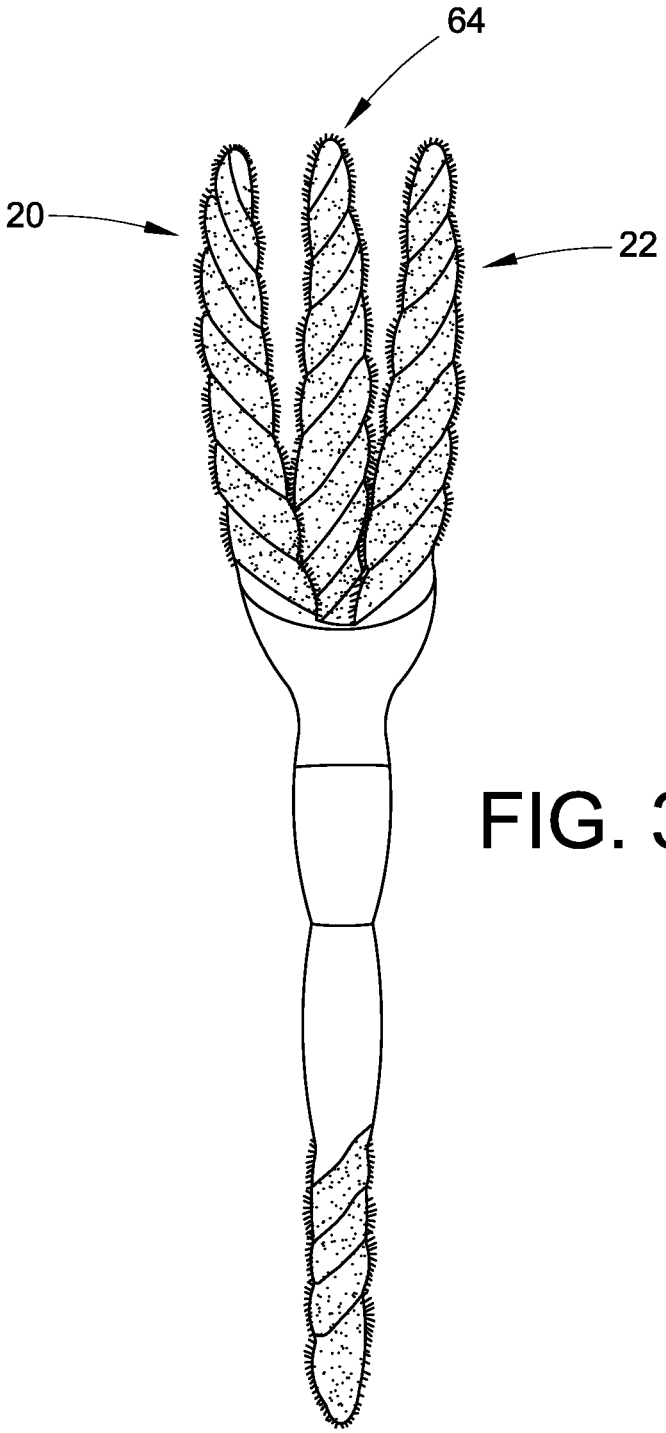
FIG. 3A is a perspective view of another illustrative embodiment of the personal hygiene device.
Figure 3B:
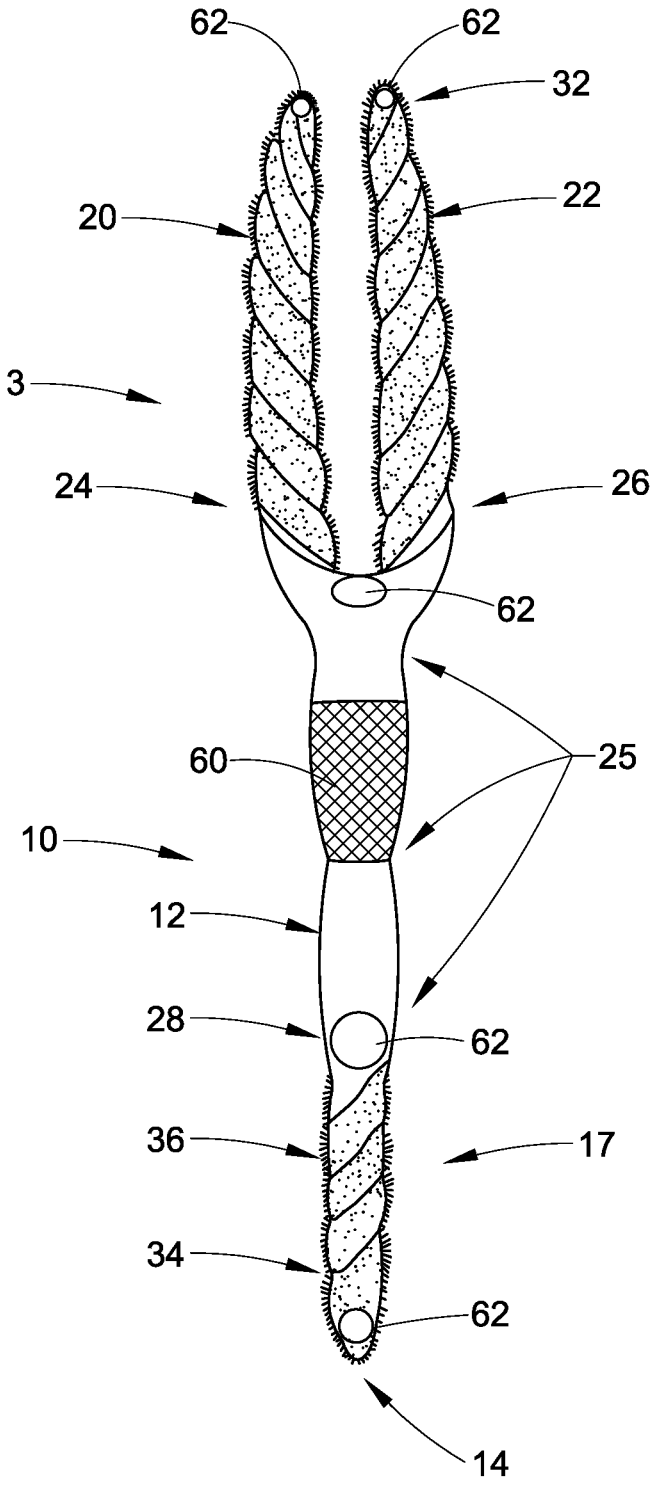
FIG. 3B is a perspective view of another illustrative embodiment of the personal hygiene device.

According to certain embodiments, and as shown in FIG. 3B, the device may include an electric motor 60 to rotate and/or vibrate the brush bristles. The electric motor 60 may be powered by batteries or any other source of suitable electric current. The motor 60 may rotate the bristles about their respective rotary axes at variable rotational speeds. The brush may also include a timed stopping mechanism to shut off the motor 60 after a pre-determined period of time.

The bristles of the device may, have variable lengths and textures for different applications. According to certain embodiments, the bristles, radiating from the brushing heads or regions may radiate in a pattern wherein at least some of the bristles overlap one another.

According to other embodiments, and as shown in FIG. 3B, the device is comprised of a light source 62 positioned at the base or tip of the brush heads allowing for increased visibility, including a timer to switch off the light at specific intervals.

The personal hygiene brush is capable of cleaning oral and body piercings, dental implants, dental implant supported dentures, and a wide variety of prosthetics and body ornaments.

The personal hygiene brush is capable of maneuvering in and around oral and body piercings, dental implants, dental implant supported dentures, and a wide variety of prosthetics and body ornaments without having to remove them from the body.

The personal hygiene brush will now be further described in connection with certain illustrative embodiments depicted in the drawing Figures. It should be noted that the personal hygiene brush should not be limited to the illustrative embodiments depicted by the Figures.

Referring now to the drawings, an exemplary embodiment personal hygiene brush is shown in FIG. 1. Referring to FIG. 1, device 10 includes an elongated handle 12 and opposite ends 13 and 14. End 13 is bifurcated into two spaced-apart cleaning heads 20 and 22. A further cleaning region 17 is located at the opposite end 14 of handle 12. Cleaning region 17 includes cleaning head 36. Heads 20, 22 and 36, in which heads 20 and 22 may be disposed in angled, generally opposed relationship to each other. Head 20 is connected to handle 12 with neck region 24 extending between head 20 and handle 17. Likewise, head 22 is connected to handle 12 with neck region 26 extending between head 22 and handle 17.

Each head 20, 22 and 36 of device 10 has a respective set 30, 32 and 34 of bristles disposed thereon and emanating therefrom. Bristles 30 extend or radiate outwardly from head 20, bristles 32 similarly extend or radiate outwardly from head 22, and bristles 34 similarly extend or radiate outwardly from head 36. The ends of the bristles of bristle sets 30, 32 and 34 are embedded or implanted in heads 20, 22 and 36 as is generally known in the art. The opposite ends of the bristles are free and are used for contacting piercings, implants, dentures, or tissue to be cleaned. The bristles of each set 30 and 32 are of substantially the same length in which the outermost ends of bristle set 30 are coextensive with the outermost ends of bristles 32. The bristles of bristle sets 30 and 32 are shown in an overlapping pattern.

Turning now to FIG. 3, another illustrative embodiment of the hygiene brush 10 is shown. The device 10 includes an elongated handle 12 and opposite ends 13 and 14. End 14 is bifurcated into two spaced-apart cleaning heads 20 and 22. Cleaning heads 20 and 22 carry bristle sets 30 and 32 respectively. Located at opposite end 14 is cleaning head 36, which carries bristle set 34. Furthermore, heads 20, 22 and 36 may be shaped in a spiralling, twisting or cork-screw manner (sec generally FIGS. 3-4C) from which bristles radiate outwards, allowing for increased surface area for the brush bristles, thereby improving the effectiveness of the device 10 when cleaning and massaging the aforementioned articles and body parts.

Figure 2A:
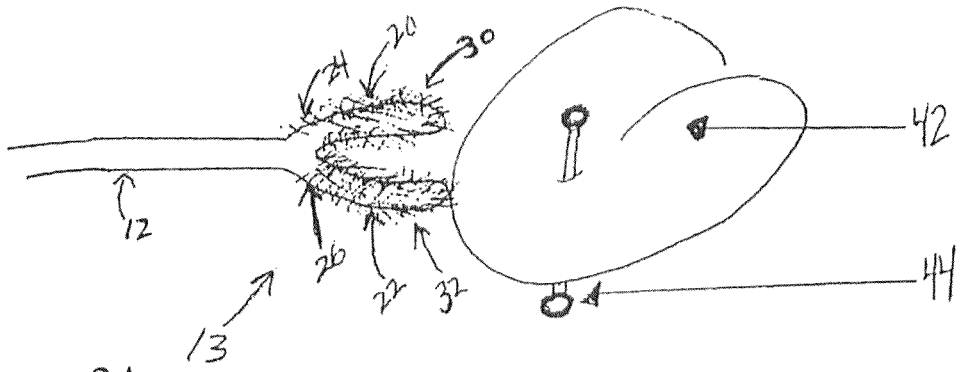
FIG. 2A is a perspective view of the furcated end of an illustrative embodiment of the personal hygiene device shown in FIG. 1 approaching a user's tongue.
Figure 4A:
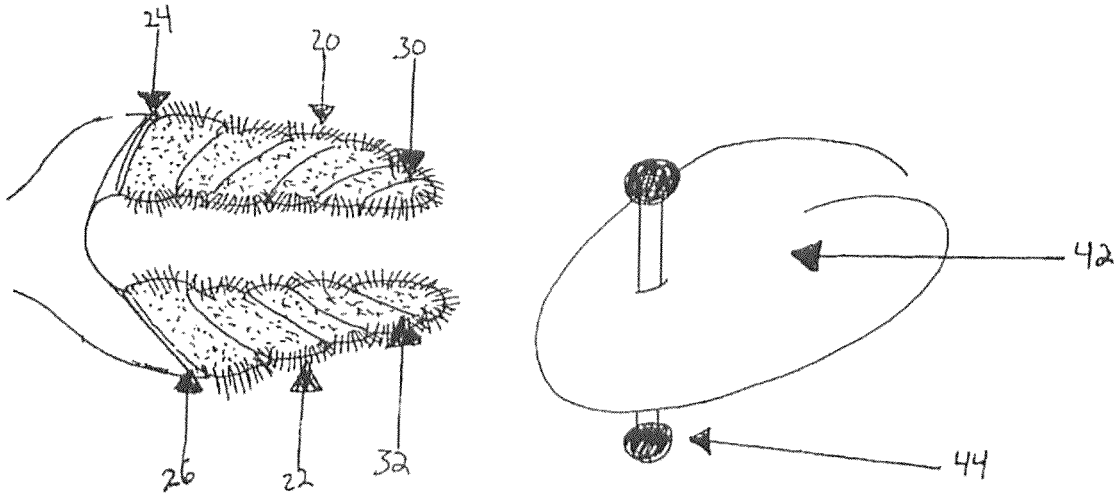
FIG. 4A is a perspective view of the furcated end of the illustrative embodiment of the personal hygiene device approaching a user's tongue shown in FIG. 3.

As shown in FIGS. 2A and 4A, the furcated end 13 may be employed to clean the epithelium and tissues (e.g., tongue 42 or palate) lining oral and body piercings 44, dental implants 48, dental implant supported structures 49, and a wide variety of prosthetics and body ornaments. The presently described embodiment of a two-headed (bi-furcated), angled and opposing arrangement of heads 20 and 22 of device 10 provides for an extended reach down onto the epithelium and tissues lining oral and body piercings 44, dental implants 48, dental implant supported structures 49, and a wide variety of prosthetics and body ornaments of a typical user. Thus, heads 20 and 22 will easily reach as for down onto the epithelium and tissues lining oral and body piercings 44, dental implants 48, dental implant supported structures 49, and a wide variety of prosthetics and body ornaments needed to thoroughly clean and massage the aforementioned areas and articles. The necks 24 and 26 provide for a continuous amount of pressure of bristles 30 and 32 on the epithelium and tissues lining oral and body piercings 44, dental implants 48, dental implant supported structures 49, and a wide variety of prosthetics and body ornaments regardless the thickness of the previously mentioned areas and articles being cleaned or massaged.

Figure 2B:
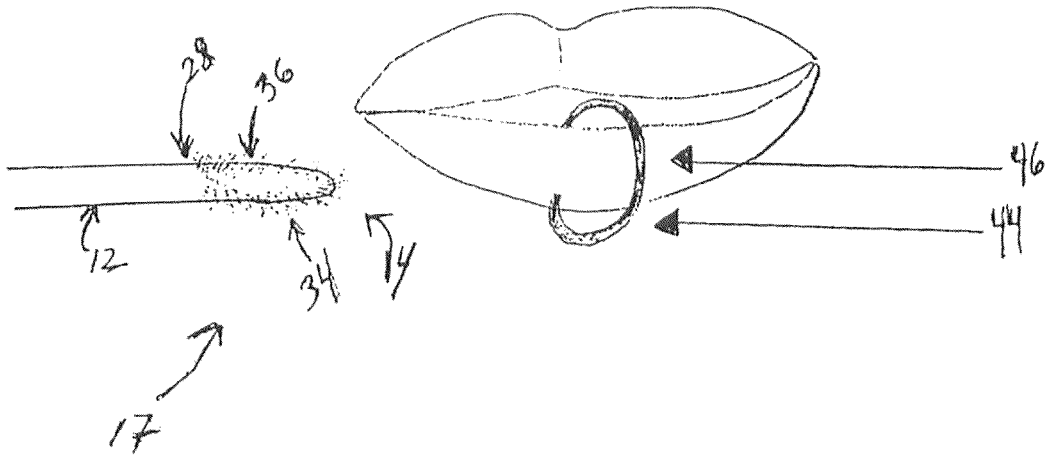
FIG. 2B is a perspective view of the opposite non-furcated end of the illustrative embodiment of the personal hygiene device shown in FIG. 1 showing brush bristles approaching a user's lips.
Figure 4B:
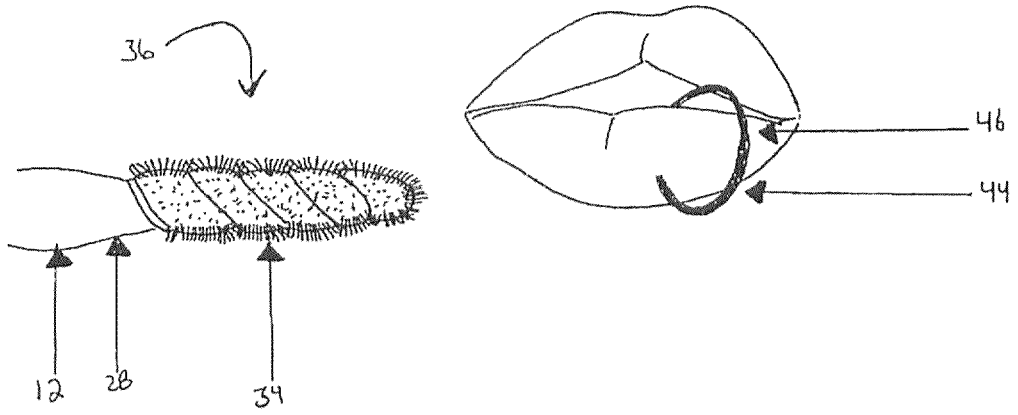
FIG. 4B is a perspective view of the opposite non-furcated end of the illustrative embodiment of the personal hygiene device showing brush bristles approaching a user's lips shown in FIG. 3.
Figure 4C:
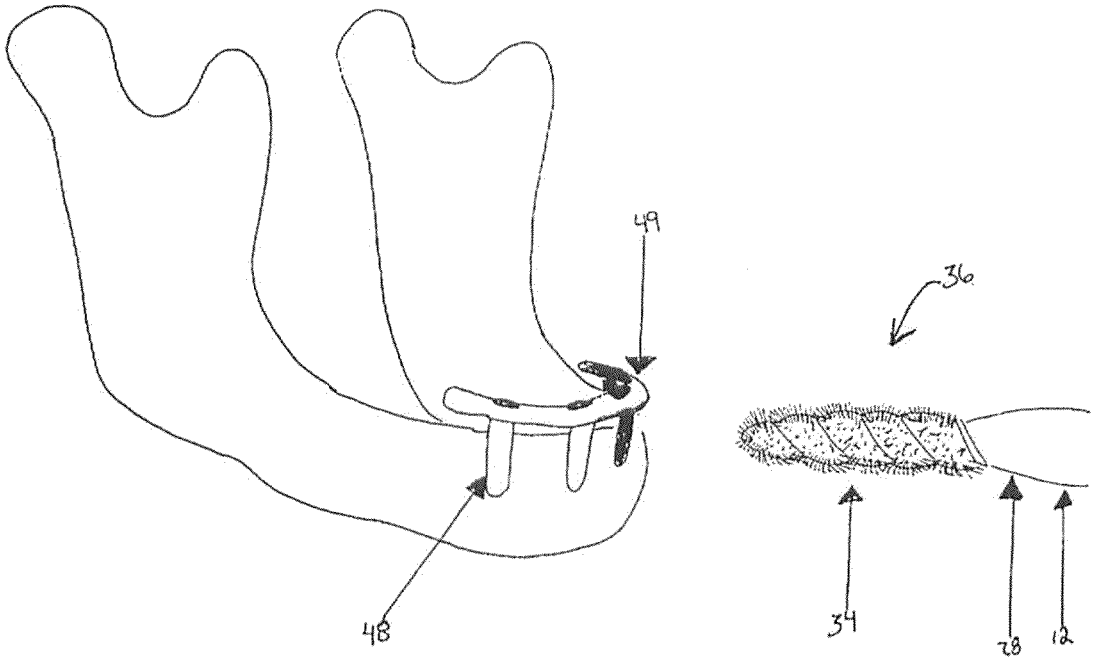
FIG. 4C is a perspective view of one illustrative embodiment of the personal hygiene device showing brush bristles approaching a user's dental implants and dental implant supported dentures shown in FIG. 3.

Device 10 may then also be nipped end for end so that cleaning region 17 can be used. As shown in FIGS. 2B, 4B and 4C, the non-furcated end 14 may be employed to clean the user's lips 46, labium or other epithelium and tissues lining oral and body piercings 44, dental implants 48, dental implant supported structures 49, and a wide variety of prosthetics and body ornaments. Head 36 is also useful for brushing the tongue and palate. Plaque on the tongue and palate is at least loosened and may be removed by back and forth strokes of bristles 34.

Alternative shapes for many of the above described elements may also be used. Less conventional circular or oblique heads may be utilized for heads 20, 22 and 36 of device 10. A third brush could easily be included for cleaning the top surfaces of the teeth simultaneously with the use of the hygiene brush to clean and/or massage the epithelium and tissues lining oral and body piercings 44, dental implants 48, dental implant supported structures 49, and a wide variety of prosthetics and body ornaments. Such a third brush may be integrally formed with handle 12, like heads 20, 22 and 36. Likewise, any other practical number of brushes could be affixed onto handle 12. Additionally, indentations 25 may be provided in the handle 12 to improve gripping and manual dexterity when in use.

While the personal hygiene brush has been described in connection with various illustrative embodiments, as shown in the Figures, it is to be understood that other similar embodiments may be used or modifications and additions may be made to the described embodiments for performing the same functions. Therefore, the personal hygiene brush should not be limited to any single embodiment, but rather construed in breadth and scope in accordance with the recitation of the appended claims.

I claim:

1. A personal hygiene device comprising:

an elongated handle having a furcated end, said furcated end defining cleaning heads, each of said cleaning heads having bristles radiating outwardly about the outer surface of said cleaning heads; and an opposite end of said handle defining a further cleaning head having bristles radiating outwardly about the outer surface of said further cleaning head.

2. The personal hygiene device of claim 1, wherein said furcated end comprises a plurality of said cleaning heads.

3. The personal hygiene device of claim 2, wherein said furcated end comprises bifurcated cleaning heads.

4. The personal hygiene device of claim 2, wherein said furcated end comprises trifurcated cleaning heads.

5. The personal hygiene device of claim 1, wherein said handle and said plurality of cleaning heads are integrally molded.

6. The personal hygiene device of claim 1, wherein said handle and said plurality of cleaning heads are separately molded.

7. The personal hygiene device of claim 1, wherein said cleaning heads comprise a spiraling shape.

8. The personal hygiene device of claim 1, wherein at least of portion said bristles overlap one another.

9. The personal hygiene device of claim 1, wherein said bristles comprise variable lengths and textures.

10. The personal hygiene device of claim 1, wherein said cleaning heads are flexible and said handle is rigid.

11. The personal hygiene device of claim 1, wherein said cleaning heads are rigid and said handle is flexible.

12. The personal hygiene device of claim 1, wherein said cleaning heads and said handle are rigid.

13. The personal hygiene device of claim 1, wherein said cleaning heads and said handle are flexible.

14. The personal hygiene device of claim 1, wherein said cleaning heads are angled from said handle.

15. The personal hygiene device of claim 1, wherein said handle and said cleaning heads comprise a synthetic polymer material.

16. The personal hygiene device of claim 1, wherein a middle portion of said handle comprises a softer or less rigid material than the other portions of said handle.

17. The personal hygiene device of claim 1, wherein a middle portion of said handle comprises a depression formed of a different material than said handle.

18. The personal hygiene device of claim 1, wherein the outer surface of said handle comprises indentations emanating outwardly therefrom.

19. The personal hygiene device of claim 1, further comprising an electric motor disposed within said handle; and transmission means extending from said motor in said handle to said cleaning heads for moving said bristles about their respective axes.

20. The personal hygiene device of claim 1, further comprising a light source disposed within said device.

* * * * *